United States Patent [19]

Quinn et al.

[11] 4,417,524

[45] Nov. 29, 1983

[54] MODULAR FILE OR THE LIKE SYSTEM

[75] Inventors: David A. Quinn, Tuxedo; Mladen Peros, Astoria, both of N.Y.

[73] Assignee: Supreme Equipment & Systems Corp., Brooklyn, N.Y.

[21] Appl. No.: 87,703

[22] Filed: Oct. 24, 1979

Related U.S. Application Data

[63] Continuation-in-part of Ser. No. 954,098, Oct. 24, 1978, abandoned.

[51] Int. Cl.[3] ..... A47B 53/02

[52] U.S. Cl. ..... 105/101; 104/287; 105/89; 105/131; 105/413; 295/36 R; 312/198; 312/250

[58] Field of Search ..... 104/165, 287; 105/89, 105/101, 131, 413; 312/198–201, 250; 64/30 R; 295/36 R; 464/46; 180/241; 280/3; 301/126, 128, 132, 135

[56] References Cited

U.S. PATENT DOCUMENTS

| | | | |
|---|---|---|---|
| 1,222,588 | 4/1917 | Allfree | 105/101 |
| 2,536,313 | 1/1951 | Schaub | 295/36 R |
| 3,020,059 | 2/1962 | Allen | 280/3 X |
| 3,923,354 | 12/1975 | Young | 312/198 X |
| 3,961,831 | 6/1976 | Showell et al. | 312/198 X |

FOREIGN PATENT DOCUMENTS

| | | | |
|---|---|---|---|
| 696130 | 10/1964 | Canada | 312/199 |
| 613471 | 7/1935 | Fed. Rep. of Germany | 295/36 |
| 2258481 | 5/1974 | Fed. Rep. of Germany | 64/30 R |
| 7612065 | 5/1978 | Netherlands | 312/201 |
| 251380 | 5/1926 | United Kingdom | 295/36 R |
| 972874 | 10/1964 | United Kingdom | 312/198 |

*Primary Examiner*—Randolph Reese

*Attorney, Agent, or Firm*—Lieberman, Rudolph & Nowak

[57] ABSTRACT

For use in a modular cabinet or the like system wherein one or more cabinet modules of unit width have rolling mobility along parallel rails which extend normal to the module-width dimension and at module-width spacing, the invention contemplates a floor-mountable track system of rigid interconnected modular rail and spacer members adapted to provide permanent guided support of one or more modules without anchorage to the supporting floor, whereby the system can be readily moved, rearranged, expanded or otherwise modified, without damage to or modification of the supporting floor. The invention also contemplates novel modular rollable base structure particularly applicable to the tiered support of cabinet modules on such a track system.

9 Claims, 6 Drawing Figures

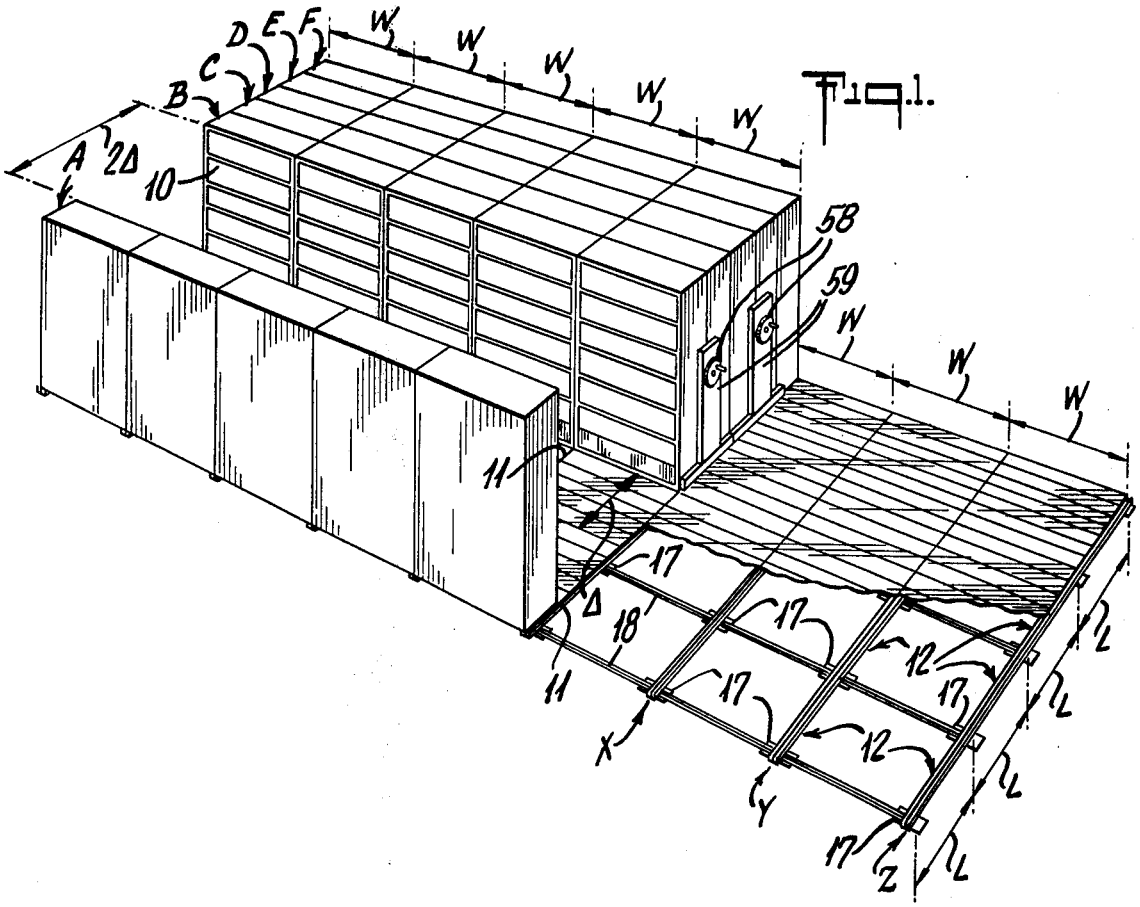
Fig. 1.
Fig. 2.
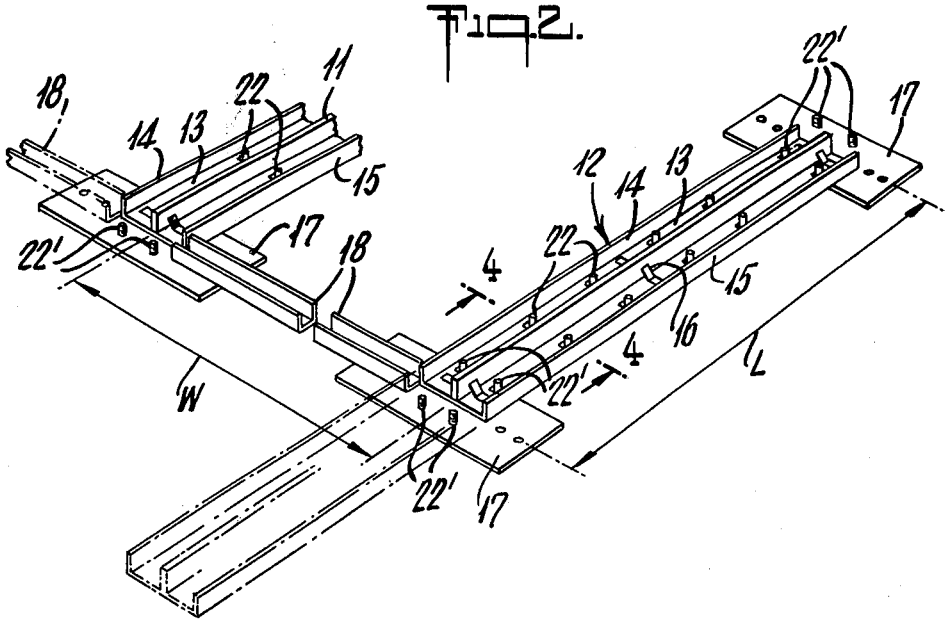

MODULAR FILE OR THE LIKE SYSTEM

This application is a continuation-in-part of our copending original application, Ser. No. 954,098, filed Oct. 24, 1978 now abandoned.

The invention relates to an improved modular multiple cabinet or shelf system for storing books, files or the like, wherein a vertical plane of front access to any given cabinet module (or tiered modules, or end-to-end connected row of the same) is available upon wheeled horizontal displacement of either the given cabinet module (or row) or the cabinet module (or row) which may be immediately adjacent the said access plane of the given module (or row), the displacement being along rails which extend normal to the said front-access plane.

In the discussion which follows, each modular assembly comprises a modular base unit upon which front-access cabinet or shelf units are assembled in vertically tiered array, and for more precise description these units will be referred to in the context of unit width W and depth D, in the horizontal-plane sense. Such module units may be assembled in end-to-end abutting succession, in which case the longitudinal extent of the assembled units is an integer multiple of the unit cabinet-module width W. The longitudinal direction of the rail system to serve moving modules of the system is of course normal to the direction W and will be referred to as a length dimension, using the symbol L.

It is well-known in the art to provide tracks upon which file cabinets and the like may be moved. However, prior practice has been either to secure the tracks directly to the floor in the room where the file cabinets will be located or to first lay a new floor constructed of concrete or the like on top of the existing floor and then secure the track to the new floor. These methods are exceedingly cumbersome and expensive, especially when new track is added lengthwise onto or adjacent to existing tracks for accommodating more file cabinets. An additional problem arises when new track is laid adjacent to existing track because there has been no practical way to connect each newly added file cabinet with an adjacent existing file cabinet so that they move simultaneously along the tracks. Furthermore, if the file cabinets are relocated to a different room, the tracks are exposed and therefore must be tolerated, ripped out of the floor, or covered with yet another floor.

An additional problem with tracks laid according to these prior methods is that particularly when leveled by grout, shims or the like, the tracks can become undulated, warped or tilted because of various stresses applied to the floor caused by weather, earthquakes, weak ground support, etc. Even minor warping or tilting of a track inhibits movement of the file cabinets thereon and increases the risk that the file cabinets will topple. If such warping or tilting does occur, a new track must be laid.

SUMMARY OF THE INVENTION

It is, accordingly, an object of the invention to provide an improved file cabinet rail system not subject to the above-noted difficulties.

Another object is to provide an improved rail-guided cabinet base for use with such a system.

It is a specific object to achieve the above objects with basic modular track-system components which enable ready disassembly, rearrangement, expansion or other modification of a given rolling-cabinet file system.

Another specific object is to achieve the above specific object with a system which neither damages the supporting floor, nor requires any adapting modification thereof.

A further specific object is to achieve the foregoing objects with demountable modular components of elemental simplicity, inherently low cost, and which is the essence of simplicity to install, service and modify, as needs for its use change in the course of time; additionally, in such a modular system, it is an object to provide enhanced safety and ease of operation in the movement of one or more cabinet modules at one time.

BRIEF DESCRIPTION OF THE DRAWINGS

Other objects and various further features of novelty and invention will be pointed out or will occur to those skilled in the art from a reading of the following specification, in conjunction with the accompanying drawings. In said drawings, which show, for illustrative purposes only, a preferred form of the invention:

FIG. 1 is a simplified perspective view of a filing system of the invention, to illustrate modification by expansion, certain parts being broken away to reveal supporting structure;

FIG. 3 is a view similar to FIG. 2, to show further interconnecting modular structure of the system of FIG. 1;

DETAILED DESCRIPTION

In FIG. 1, the invention is shown in application to a rollable multiple-row modular file-cabinet system, such as a law library, in the process of expansion. Each row of the original installation illustratively comprised seven vertically stacked tiers of five end-to-end connected cabinet modules 10. The outer fixed (i.e., non-rollable) rows A, F comprise single modules in tiered and end-connected array. The inner rollable rows B, C, D, and E are similarly tiered and end-connected, but additionally are back-to-back connected as doubled pairs, each doubled pair being supported on rollable base structure to be described in connection with FIG. 3. Concealed wheels forming part of each such modular base enable the cabinets of each doubled pair, such as the pair B–C or the pair D–E, to be selectively moved as a unit along spaced parallel rails 11. With the doubled pairs moved as much as possible to one or the other of the fixed outer rows A, F, a single aisle space Δ, as of double cabinet depth, is presented at any one time, for selective access to files, books or the like via the opposed front-access planes of the module rows involved. Thus, for the cabinet modules shown in FIG. 1, the original requisite floor-area dimensions were five times the unit width W of each module (i.e., 5 W), by Δ plus six times the unit depth of each module. Illustratively, therefore, for modular cabinet width of 36 inches and depth of 12 inches, and with a 36-inch aisle allowance Δ, the overall floor-space requirements were 9 feet by 15 feet (i.e., 135 sq. ft.) for a cabinet-module capacity of 6×7×5, or 210 cabinet modules.

However, the system of FIG. 1 is in the process of expansion, illustratively in two horizontal dimensions, both in the quadrant direction from which the view of FIG. 1 is taken. To this end, all existing rails are extended by one modular length L, illustratively 36 inches, while additional rails 11, at locations X-Y-Z and modular width spacings W, will expand each row of the system to eight end-to-end connected modules. FIG. 1 happens to display the point in time at which the first fixed row A has been relocated, to its ultimately expanded location, thereby permitting addition of a new double rollable row (not shown), for example in the double-aisle space 2Δ which has just been developed upon outward relocation of the fixed row A. When fully expanded and implemented by further rollable base modules and by seven-tiered stacks of cabinet modules, the capacity of the system will be 8×7×8, or 468, cabinet modules, all contained within a floor-area requirement of 12×24 feet (i.e., 288 sq. ft.), thus substantially more than doubling the cabinet module capacity, for a little more than doubling of the floor area involved.

Figure 2:
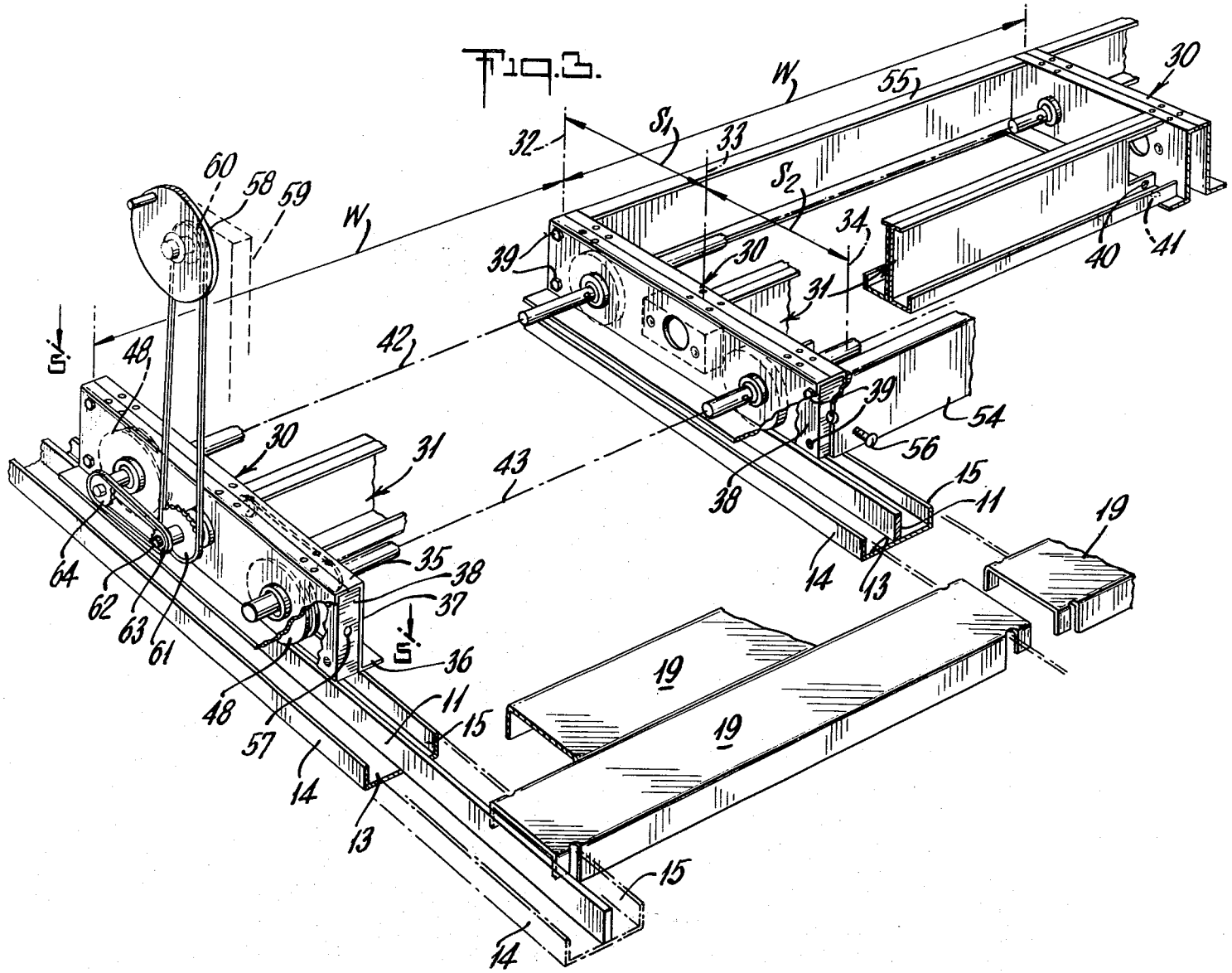
FIG. 2 is an enlarged fragmentary view in perspective to show interconnecting modular structure of FIG. 1.

Directing additional attention to FIG. 2, the foregoing result will be seen in large part to be attributable to the grid-like nature of connected rail and spacer members constituting the basic support structure beneath original and expanded versions of the indicated file-cabinet system. In the support system illustrated, unit-handling rail members 12 are of unit length L; each member 12 comprises an upwardly facing channel having a relatively wide base 13 between like upstanding sidewalls 14–15, and the associated rail 11 is a steel bar of rectangular section, edge-mounted at the central alignment of base 13. Three longitudinally spaced straps 16 clamp rail 11 firmly to base 13 via similarly spaced broached openings in rail 11. The rail members 12 are interconnected in end-to-end aligned array (e.g., at each of the newly added alignments X-Y-Z) by splice plates 17 having orthogonally related dimensions which preferably exceed the overall sidewall-to-sidewall width of the rail-supporting channel. It will be understood that at proper rail-member overlap with a splice plate 17, plural apertures register in both the channel base 13 and plate 17 to enable multiple bolting of each channel end to a connecting splice plate. Consistent modular spacing W between adjacent parallel rails 11 is achieved by bolted assembly of channel members 18 to splice plates 17 at end overlap therewith. Preferably the upstanding side walls of the spacer channels 18 are vertically coextensive with sidewalls 14–15, whereby said sidewalls may define and establish a single horizontal plane of flooring support, between adjacent rail alignments. In FIGS. 1 and 3, such flooring is seen to comprise plural like downwardly flanged panels 19, of overall length to derive support at one end from the sidewall 15 of one rail-member channel and at its other end from the sidewall 14 of the next-adjacent rail-member channel, the flanges of panels 19 being locally cut away to permit such controlled location of each panel 19 as to assure an end clearance with respect to the adjacent rail 11.

Figure 4:
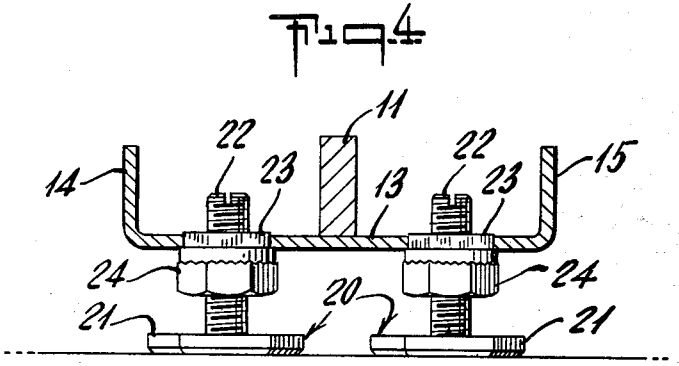
FIG. 4 is an enlarged vertical sectional view taken at 4—4 of FIG. 2.

Description of the support structure is completed by noting the plural spaced adjustably elevated feet which depend from spaced locations along each rail-member alignment, an illustrative pair of such feet being shown in FIG. 4. Each foot element 20 is shown as a bolt with a large-span hexagonal head 21, and an elongate threaded shank 22 of the bolt is adjustably received in a flanged nut insert 23 which is a force-fitted part of the channel base 13. A lock nut 24 is carried by shank 22 between head 21 and nut 23 and is provided with upper-surface serrations, for positive retention of a locked relation of nut 24 against nut 23. It will be understood that further spaced pairs of threaded foot elements 20 may be similarly incorporated in the splice plate, with their threaded shanks 22' passing through large unengaged holes in the channel base 13.

In practice, the described rail-support system is first assembled at the desired floor location, via splice plates 17, to the desired modular unit dimensions, e.g., 3 L by 5 W, or 4 L by 8 W. The system is then leveled by threaded adjustment of feet 20, as necessary, and all lock nuts 24 are then firmly secured. Should an expansion be made from an existing system, as from the 3 L by 5 W initial example here, to the expanded 4 L by 8 W system outlined in FIG. 1, the assembly and leveling process proceed from direct referencing connection of new rail members 12 and spacer members 18 to existing installed splice plates 17 which are exposed at modular intervals along the edge limits of the pre-existing 3 L by 5 W structure.

Figure 5:
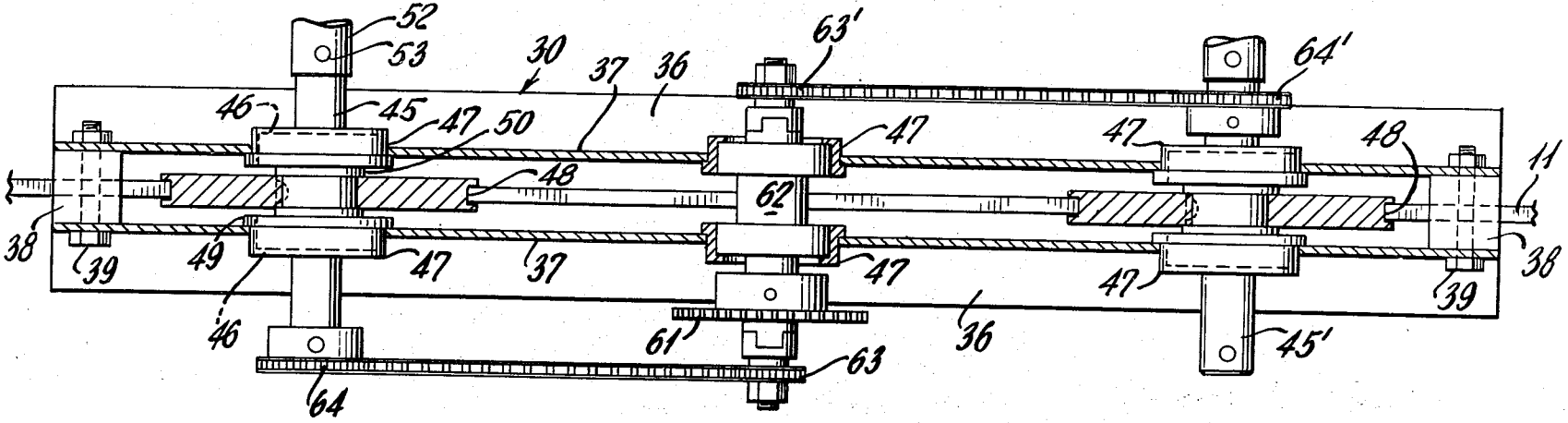
FIG. 5 is a horizontal sectional view taken along the line 5—5 of FIG. 3.

Having thus far accounted for the basic supporting rail structure and its leveling, all without having to mar or destroy any part of existing floor, FIGS. 3 and 5 will be additionally considered in a description of the modular rollable base structure for mounting multiple tiers of cabinet modules. But first, it will be explained that, for aesthetic purposes, fixed outer base units to support the cabinet modules of outer non-rollable rows A and F are provided with suitable means for seated and preferably bolted support upon and between adjacent bases 13 and sidewalls 14–15 of adjacent rail-channel members, and that these fixed base units may be of effective height to place all non-rollable cabinet modules at elevations corresponding to elevations of their rollable counterparts. It will also be understood that the depth dimension of such fixed base row A is such as to enable close but removably assembled placement of an integer number of floor panel modules 19 in the space between the fixed base units of outer rows A and F. For example, if the effective depth dimension of the fixed base units is 9 inches, a 3-inch cabinet-module overhang in rows A and F will exist to reduce the chances of inadvertent kicking of the base unit; with this 3-inch overhang, and with panels 19 of width L/6 (i.e., 6 inches in the present example of L equal to 36 inches), the space between outer-row base units of the 4 L by 8 W expanded system will be 10.5 feet and will neatly accommodate 21 floor panels, for each space between rail alignments.

In FIGS. 3 and 5, each rollable modular base unit is seen to comprise spaced parallel downwardly open end-frame channels 30 at effectively rail-to-rail spacing W between channel centers. These channels 30 are bolted together by means of effectively a single central beam 31, and the upper surfaces of channels 30 and beam 31 lie in a single horizontal plane to establish a generally H-shaped pattern of support for the lowest-tier cabinet modules assembled thereto, in back-to-back relation. In FIG. 3, the span $S_1$ between upstanding phantom lines 32–33 will be understood to indicate the depth placement of one lowest-tier cabinet module, while the span $S_2$ between phantom lines 33–34 similarly indicates placement of the other lowest-tier cabinet module which is back-to-back assembled thereto.

In the preferred form shown, each of the channels 30 is an assembly of two opposed duplicate channel halves, each being of generally Z-shaped sectional configuration and characterized by oppositely directed upper and lower elongate horizontal flanges 35–36 integrally connected by a large vertical wall 37 of the channel 30. At each end of the channel a spacer block 38 fills the end and enables rugged bolted assembly of walls 37 to each other, at bolt locations 39. Also as shown, the beam 31 is an assembly of two like flanged members of generally L-section, which may be secured to each other as at 40, and similarly secured at 41 to the applicable lower flange 36 of the applicable channel 30. It will be understood that upper flanges of the channel halves may be preformed with suitably spaced apertures, as shown, for later accommodation of self-tapping screws employed to secure the assembly of the lowest-tier cabinet modules thereto.

For rolling suspension of two wheels per channel 30, shaft-mounting openings are provided in the spaced sidewalls 37 of each channel, on first and second longitudinal alignments 42–43 at opposite lateral offsets from the beam 31, and a separate axle element 45 extends through each thus-aligned pair of channel-wall openings and has journaled rotational support in each channel wall. In the form shown, the journaled support is in each case provided by antifriction means 46 such as a ball bearing having its inner ring seated upon the axle and its outer ring seated in a flanged cup or bushing 47, which in turn locates in the channel-wall opening provided for journal support. Between locations of journal support, a wheel 48 is centrally located and secured as by a key to axle element 45, and both axle ends project outwardly of their journal-support locations. As shown in FIG. 5, the central positioning of axle 45 and wheel 48 between channel side walls 37 is assured by the described flanged-cup relation to the channel-wall openings and by an integral shoulder or flange 49 to locate one bearing inner ring and one side of wheel 48, while a spacer ring 50 of axial extent corresponding to that of flange 49 locates the other side of wheel 48 with respect to the inner ring of the opposite bearing. Adjacent projecting ends of axles at adjacent channels 39 and on the same alignment 42 (or 43) are interconnected with adequate torsional rigidity by means of an elongate tubular member 52 having telescopic overlap with both adjacent axle projections and by means 53 of such precision and stiffness as to enable two such tubular connections 52 (on alignments 42, 43) to materially add to the structural integrity of each modular unit of the frame members 30–31.

For most channel 30 locations, it is not necessary to adopt any special guidance relation or measures to assure wheel 48 alignment with the rail 11 upon which it rides, it being sufficient and preferred that such measures taken at the longitudinal-end channels 30 of each row (e.g., B–D and D–E) are sufficient to assure that all wheels 48 of all channels 30 ride their associated supporting rails 11. Thus, wheels 48 at the end channels 30 are preferably double-flanged, the flanges deriving guidance from the sides of their associated rails, while the wheels 48 at the intermediate channels 30 are unflanged, it being noted that the rail-running width of the unflanged wheels (e.g., $\frac{3}{4}$ inch) substantially exceeds the width (e.g., $\frac{1}{4}$ inch) of the associated rail 11.

As with the case of extending the rail-support grid system, so also with extension of the rollable modular base system; expansion may be achieved by assembling the described rollable-base module components, to the exposed end of the existing structure and to each other, with minimum dislocation of existing structure. Thus, for the assumed expansion situation, a complete new 8-unit double-row rollable base may be assembled in situ along the full 8 W extent of the track system, as in the expanded-aisle alignment shown in FIG. 1 between fixed row A and the next-adjacent double-row unit B–C; this full-length 8-unit assembly will ride on nine parallel alignments of rails 11, the last three such alignments being designated X-Y-Z. Therefore, the new full-length assembly will involve nine channels 30, each preassembled with its two axles 45 and associated flanged or unflanged wheels 48, and the framing of all rollable base units is completed by bolted connection of spacer beams 31 between channels and by press-fit pinned connection of all torque tubes 52 to the telescopically overlapped axle ends with which they are associated. The torsional rigidity of axle connections on the alignment 42 and on the alignment 43 will be understood to assure against any tendency of the new double-row assembly to skew with respect to the supporting rail alignments in the course of rolling displacement.

Having completed frame construction of the full-length rollable base, suitably flanged front and rear panels 54–55 may be installed, it being shown in FIG. 3 that flat vertically oriented longitudinal ends of these panels seat against channel-end spacer blocks 38, with each panel 54 (55) in end-to-end adjacency with the next such panel 54 (55), single bolt 56 being driven into a tapped hole 57 in block 38 to hold panels 54 (55) assembled to the described frame.

If the described rollable base structure is small enough or lightly loaded with tiers of cabinet modules, the rolling displacement of the double row involved may be achieved by direct manual force, applied anywhere along the double row. But for greater ease of driving such displacement, a hand wheel 58 is mounted to the row end, with sprocket connection to one or both of the shaft alignments 42–43. To this end, an upstanding sheet-metal box-like frame (suggested at 59) is mounted to the base channel 30 and to the end face of cabinet modules in the assembled double row, thus providing an elevated location for journaled support of a short shaft to which both hand wheel 58 and a sprocket wheel 60 are keyed. The frame 59 also protectively encloses a first endless sprocket-chain connection from wheel 60 to a driven sprocket wheel 61 pinned to an intermediate short shaft 62 which is journaled at a central location in the end channel 30; as shown in FIG. 5, the driven sprocket wheel 61 is large compared to the driving sprocket wheel 60, thus achieving mechanical advantage through speed reduction. A second sprocket wheel 63 is also mounted to shaft 62 and is keyed to wheel 63 to serve another speed-reducing sprocket-chain connection to a driven sprocket wheel 64, shown pinned to the axle 45.

Under most circumstances, the described single-shaft alignment (42) drive will be found adequate and easy acting, in view of the consistent use of ball-bearing suspensions and in view of the indicated speed-reduction relation between hand wheel 58 and the driven shaft alignment. However, in the event that it should be desired to provide coordinated drive to both shaft alignments 42 and 43, a second sprocket-wheel pickoff is readily made at 63', namely, at the inner end of shaft 62, with a third sprocket-chain coupling to a driven sprocket wheel 64' on the second axle 45' of the end channel 30. All externally exposed parts of the drive system will be understood to be suitably encased by sheet-metal enclosures (not shown) but removably secured to end frame or end panel surfaces which have been described.

The description for the full-length new double-row rollable base will be seen to be equally applicable to the rollable-base extensions that are needed to extend the capacity of rows B–C and D–E. In each case, having first removed (from the original ends of rows B–C and D–E) the hand wheel 58, the auxiliary box frame 59 and all exposed sprocket wheels and chains, the first new beam 31 may be secured to the then-exposed end channel 30 and all further channels 30 and beams 31 assembled thereto, as previously described, it being noted that to avoid beam interference with the intermediate shaft 62 of the original system, the outer channel half of the outer channel 30 may be unbolted from its inner half, thus freeing the shaft 62 and its suspension for total removal, prior to reassembly of the removed channel half.

To avoid beam (31) interference with the shaft 62 at beam connection to the end channel 30, the last beam 31 may be omitted or, preferably, the web of beam 31 may be locally cut out for clearance with shaft 62 and its sprocket wheel 63'.

For simplicity in the foregoing description, the indicated expansion in the track-length direction L has been assumed to involve a full modular track-member unit L, which illustratively means a 3-ft. expansion. However, for such 3-ft. expansion, only one further rollable double-row unit has been added, meaning a two-foot use of the 3-ft. added L dimension, thereby providing a one-foot widening of the previously existing 3-ft. aisle allowance Δ. For the situation in which available floor space does not permit the luxury of thus expanding from a 3-ft. to a 4-ft. aisle allowance, we provide the rail-member units in submodular fractional lengths, as for example, of length 2L/3 or L/2. Thus, in the assumed L-expansion situation, use of 2L/3 submodular rail members will permit the desired expansion, without expansion of the aisle allowance Δ, and use of L/2 submodular rail members will permit the desired expansion at only a six-inch loss of space on the original 3-ft. aisle allowance Δ. And as long as any such submodular rail-members are related by integer multiple to the floor-panel unit width, here taken as L/6' the floor-panel accommodation is correct, whatever the expansion in the L direction.

In the foregoing description, the reference to modular cabinets will be understood to be illustrative of but one of a variety of article-storing modules which can be accommodated by the described modular track and rollable-base systems. Thus, upstanding frames at alignment with channels 30 may accommodate modular systems of shelving, clothes-rack, or other storage accommodation, and the reference to modular cabinets will be understood to contemplate such storage structures.

Also, while manual drive via hand wheel 58 may be perfectly satisfactory for many applications, such a drive is to be deemed to be illustrative, in that electric-motor operated drive of one or both shaft alignments 42–43 may be desired in certain applications.

The described construction will be seen to have satisfied all stated objects and to have provided very substantial improvement over existing systems. In particular, the rail height above channel base 13 will be understood to be at or just below the top surface plane of floor panels 19, thus avoiding any chance that a rail will trip the shoe of operating personnel. And the end clearance between panels 19 and the adjacent rail surface may be so small as not to present a hazard to small heels of operating personnel, it being understood that such clearance is needed only to clear the width of the rolling wheels 48 associated with each rail.

Figure 6:
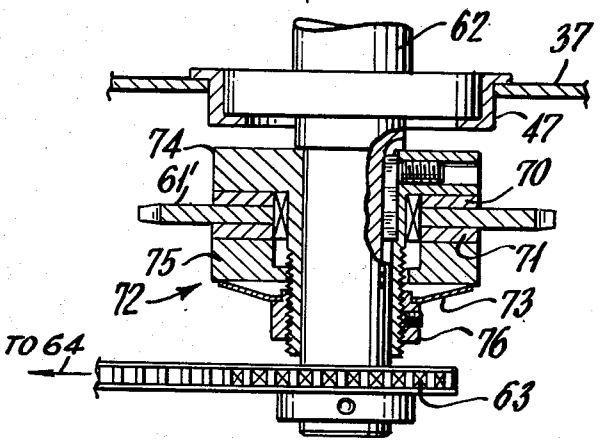
FIG. 6 is a fragmentary enlarged horizontal sectional view along line 5—5 of FIG. 3 to show a modification.

While the invention has been described in detail for the preferred form shown, it will be understood that modifications may be made without departing from the claimed invention. For example, in the modification illustrated in FIG. 6, the sprocket wheel 61' which receives drive torque from the chain connection to hand wheel 58 is rotatable with respect to the central lower shaft 62 to which it is mounted; at the same time, sprocket wheel 61' is axially squeezed between friction plates 70–71 of a slip clutch 72 mounted to the central lower shaft 62. The squeeze force is developed by an axially preloaded Belleville washer 73 which reacts between a flanged hub member 74 and a compression ring 75 which has angularly keyed and axially slidable relation to the hub of member 74; a nut 76 threaded to the hub of member 74 permits adjustment of the compressional preload of the friction engagement to sprocket wheel 61', and hub member 74 is keyed at 77 to shaft 62. The preload of clutch 72 is adjusted so that a safe upper limit characterizes the amount of torque that may be transmitted to shaft 45 (or shafts 45—45'), thus effectively uncoupling the driving force whenever sudden or excessive driving force is applied at 58, or when a restriction (such as a person) is present in an aisle which is being collapsed by cabinet-module displacement.

What is claimed is:

1. A modular rollable base adapted to support two like front-access cabinets or the like modules in back-to-back relation, the base including a modular frame comprising at least one pair of elongated channels arranged parallel with one another and downwardly open at longitudinal ends of the frame; an elongated longitudinal beam secured at its ends to respective midpoints of said pair of elongated channels, said longitudinal beam and said elongated channels being of substantially the same height and establishing an H-pattern of continuous cabinet-module support in a horizontal plane, said elongated channels each having a pair or substantially parallel side walls, each side wall having at least one pair of shaft-mounting openings, said pairs of shaft-mounting openings in said side walls being aligned with each other and arranged to be on opposite ends of said elongated channels with respect to said respective midpoints, corresponding aligned shaft-mounting openings in respective elongated channels being in alignment with each other; a plurality of axle elements each extending through a respective aligned pair of said shaft-mounting openings in said elongated channel; a plurality of rotational support means each arranged in said shaft-mounting openings of each channel wall for rotationally supporting said axle elements, each of said axle elements having a projecting end extending outward of its associated rotational support means; a wheel secured to each axle element between the locations of its associated rotational support means, said wheel having a radius which is sufficiently long so that a portion of said wheel extends beneath said frame; first and second tubular shaft elements extending longitudinally between respective opposite ends of said elongated channels for engaging with said projecting ends of respective ones of said axle elements extending through said aligned shaft-mounting openings in said respective ones of said elongated channels, and a plurality of rigid connection means for rigidly connecting said first and second tubular shaft elements to said projecting ends of said respective ones of said axle elements whereby respective ones of said axle elements are rotatively and axially coupled to one another, and thereby provide enhanced structural integrity for the modular rollable base.

2. The base of claim 1, in which said plurality of rigid connection means comprises a plurality of pin means which are arranged to extend diametrically through axially overlapped tubular shaft element and axle element regions.

3. The base of claim 1, in which said wheels of at least one of said elongated channels are double-flanged, for stabilized guidance with respect to both sides of an upstanding rail.

4. The base of claim 1, in which there are further provided a first sprocket wheel which is carried by a projecting end of at least one of said axle elements, and remotely operable means including a first sprocket chain engaged to said first sprocket wheel for unitary driving of all axle elements connected to said one axle element.

5. The base of claim 4, in which there are further provided a second sprocket wheel which is carried by a projecting end of the other axle element of said elongated channel which mounts said one axle element, and means including a second sprocket chain engaged to said second sprocket wheel for driving all axle elements connected to said other axle element, in unison with the drive of all axle elements connected to said one axle element.

6. The base of claim 4, in which said remotely operable means includes frame structure extending upward from the base and coupled to said elongated channel which mounts said one axle element, a hand wheel journaled for rotation in said frame structure, said frame structure being arranged adjacent to the associated end wall of cabinet modules carried by the base.

7. The base of claim 4, in which said remotely operable means further comprises slip-clutch means for limiting a torque applied to said first sprocket wheel.

8. The base of claim 1, wherein there is further provided remotely operable means including a slip-clutch drive.

9. The base of claim 8, in which said slip-clutch drive includes friction engagement means which is resiliently loaded, and selectively operable means for varying the magnitude of such resilient loading.

* * * * *